United States Patent [19]

Lefnaer

[11] 4,097,966

[45] Jul. 4, 1978

[54] BINDING CLIP FOR BUNDLING AND/OR ATTACHING CABLES AND SIMILAR OBJECTS

[75] Inventor: Otto Lefnaer, Stuttgart-Botnang, Fed. Rep. of Germany

[73] Assignee: Württembergische Allplastik GmbH, Fed. Rep. of Germany

[21] Appl. No.: 676,146

[22] Filed: Apr. 12, 1976

[30] Foreign Application Priority Data

Apr. 12, 1975 [DE] Fed. Rep. of Germany ..... 2516005

[51] Int. Cl.[2] ..... B65D 63/10; H02G 3/26

[52] U.S. Cl. ..... 24/16 PB

[58] Field of Search ..... 24/16 PB, 16 R, 17 R, 24/17 A, 17 B, 17 AP, 19, 73 SA, 20 TT, 25, 73 PB, 73 PF

[56] References Cited

U.S. PATENT DOCUMENTS

| | | | |
|---|---|---|---|
| 3,102,311 | 9/1963 | Martin et al. | 24/16 PB |
| 3,214,808 | 11/1965 | Litwin | 24/16 PB |
| 3,875,619 | 4/1975 | Fortsch | 24/16 PB |
| 3,887,965 | 6/1975 | Schuplin | 24/16 PB |

*Primary Examiner*—Werner H. Schroeder
*Attorney, Agent, or Firm*—Craig & Antonelli

[57] ABSTRACT

In order to design a binding clip employed in particular for attaching or bundling cables as soft and pliable as possible, so that it can be guided well about corners, etc., there is a very deep longitudinal groove in a tongue portion of the binding clip, in which the profile which is engaged by engagement means of the head portion is recessed. The deep longitudinal groove increases the flexibility of the binding clip in the lateral direction without reducing its tensile strength. Moreover, the recessed arrangement of the profile provides a smooth outer surface of the binding clip, which cannot result in injuries to the user of the binding clip.

16 Claims, 10 Drawing Figures

BINDING CLIP FOR BUNDLING AND/OR ATTACHING CABLES AND SIMILAR OBJECTS

The present invention relates to a binding clip for bundling and/or attaching cables and similar objects, having a tongue portion of round or flat cross section, one end of which is capable of being introduced into the head portion formed on the other end thereof in one piece, and having engagement means which engage a profile of the tongue portion.

Binding clips of this nature are employed for bundling cables, wires, rods, sections and tubing or for binding plants in agriculture, or for closing sacks, bags and similar objects. They are also employed for retaining an individual object, for example a cable, tube, plant or similar object, in a given location relative to another member.

In a known design (German Pat. No. 1,085,809), the tongue portion has knot-like enlargements of a given profile, which then permit the binding clip to be closed when the neck, arranged between the knots, is introduced into a small aperture in the head portion. In actual practice, this design has proven to be extremely good, in particular for closing sacks. However the profiles on the outside of the tongue portion presented difficulties for many fields of application. If sensitive objects must be connected or retained with a binding clip of this nature, there is a danger of the knot-like profiles damaging the object in question. Moreover, the knot-like profiles can overstrain the hands of a person attaching and closing binding clips of this type the entire day.

Also known is a binding clip (British Pat. No. 1,035,143), intended particularly for cables, in which the tongue portion is not serrated. The head portion of this binding clip has a sharp locking tongue of metal, which penetrates into the smooth surface of the tongue portion and remains in place there. Fabrication of this binding clip is extremely complicated, as the metal locking tongues must be forced or otherwise introduced into the material of the binding clip. This means that when the binding clips are fabricated, the mould must be equipped with a plurality of small metal plates before the plastic is injected. This involves time-consuming work or a highly sophisticated automatic apparatus. Moreover, the retaining force of a binding clip of this nature is relatively limited. In the event of overstrain, the spring-like locking tongue would be bent upwardly. As a result of its hardness and sharpness, the metallic locking tongue would cut a notch into the plastic tongue portion. This binding clip can therefore not be subjected to enough force to be able to fully utilize the load capacity of the cross section of the material of the tongue portion.

In order to eliminate the fabrication difficulties incurred with the aforementioned design, it is known practice (German Pat. No. 1,275,650) to insert a metallic member subsequently into the head portion of each and every binding clip, for which purpose the head portion is provided with an appropriate shoulder. Moreover, in this design one side of the tongue portion has a serration, which is engaged by the locking tongue. In order to keep the metallic member forming the locking tongue in its position, lateral longitudinal ribs are provided on the tongue portion, which press the metallic member into its correct location. However this design is also subject to the same difficulties with respect to closing force, while the fabricational effort is, in all probability, even significantly greater than that required in connection with British Pat. No. 1,035,143, as after being injection moulded, each and every binding clip must again be picked up in order to equip it with the metallic member, which then also probably necessitates the use of a tool.

It is also known practice (U.S. Pat. No. 3,127,648) to design the elastic locking tongue as an integral part of the heat portion, fabricated of plastic, and to have it engage a serrated profile on one side of the tongue portion. In order to ensure the elasticity of the locking tongue, it is also necessary for the head portion to be relatively high. The closing forces of these binding clips are relatively low, as the elastic locking tongue of plastic yields when subjected to even relatively low forces. Moreover, handling of this design, in the same manner as handling of the design with the metallic locking tongue (German Pat. No. 1,275,650), is not particularly pleasant, as the sharp edges of the serrated profile must be grasped by the user's hand.

In all of the aforementioned designs, the locking tongue must have a certain length in order to permit sufficient elastic deformation. Since the locking tongue must be arranged outside the area of the cross section of the tongue portion, the height of the head portions relative to the cross section of the tongue portion must of necessity be relatively great.

It is the object of the present invention to create a binding clip of the character described at the outset, having a smooth outer surface which does not impede handling or damage the objects, whose head portion must only be relatively low and which can, in addition, be fabricated simply and economically.

According to the present invention, the tongue portion has one or more longitudinal grooves in which the profiles are provided in a recessed manner relative to the outer surface thereof.

A binding clip of this type has smooth surfaces on all sides, which are only interrupted insignificantly by the longitudinal grooves. The height of the head portion can be kept relatively low, as a large portion of the elastic movement can take place within the cross section of the tongue portion, i.e. within the longitudinal grooves. Moreover, the longitudinal groove or grooves provides or provide the advantage that the binding clip can also be deformed relatively easily at right angles to the longitudinal axis of the tongue portion, for example in order to lead it around an edge. In this case, a binding clip with a round tongue portion opens up and offers a slight resistance against bending. A binding clip with a flat tongue portion can be bent laterally, which is of particular advantage, for example, if the cables or similar objects held by the binding clip must be angled about the binding clip or if the binding clip is attached to highly curved cables.

In a development of the present invention, the head portion engages the profiles with one or more serrated members which are retained on the head portion by means of elastically deformable members. The longitudinal grooves and the profiles, which are preferably provided at the base thereof, can be kept very narrow since, as a result of their length, the serrated members offer a sufficiently great engagement surface, without the width of the profile being of significance. As a result of the serrated members, whose teeth would all have to shear off for the binding clip to rip open, an extremely high closing force is provided while the height, especially of the head portion, is kept relatively low so that these binding clips can also readily and advantageously be employed in miniature electronic equipment, such as pocket calculators, etc.

In an advantageous embodiment with a low head portion, a hammerhead-like enlargement, containing a slot arranged perpendicular to the longitudinal axis of the tongue portion and into which the engaging member or members protrudes or protrude, serves as the head portion.

In a further embodiment of the present invention, two longitudinal grooves, arranged one opposite the other and having profiles, are provided in the tongue portion, preferably of flat, rectangular cross section, with two serrated members protruding laterally into the slot in the head portion being associated thereto. In this embodiment, the closing forces required for closing the binding clip are divided between two profiles and two serrated members, thereby permitting both to be relatively narrow and readily arranged in the side edges of a flat binding clip. A binding clip of this nature always provides a smooth surface to the objects to be bundled or attached and surrounded, regardless of the manner in which they are surrounded.

In another embodiment of the invention, which is suitable for tongue portions of both flat, rectangular cross section and circular cross section, a longitudinal groove having a profile is preferably arranged on that side of the tongue portion facing away from the object to be surrounded, the longitudinal groove being engaged by a serrated member, which is retained by means of elastic members.

The above discussed and other objects, features and advantages of the present invention will become more apparent from the following description thereof, when taken in connection with the accompanying drawings, in which FIG. 1 shows an axial section taken through a head portion of a binding clip according to the present invention, with tongue portion inserted and locked in place;

Figure 1:
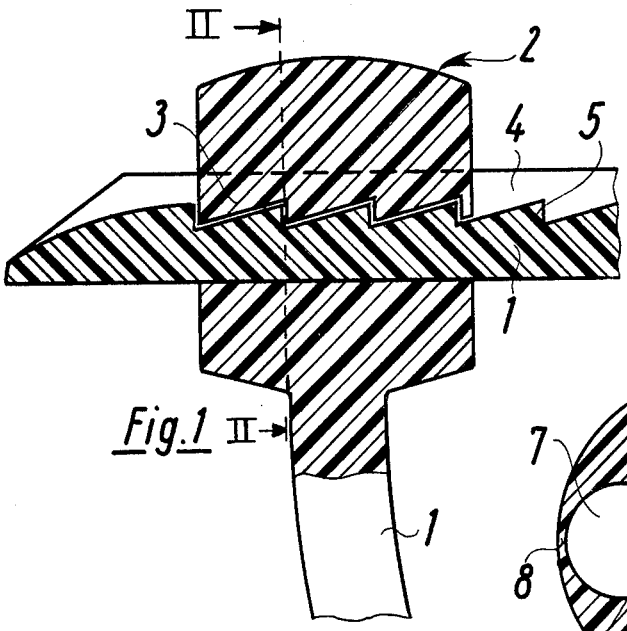

Referring now to the drawings, wherein like reference numerals designate like parts throughout the several views, the binding clip shown in the drawings is injection moulded of an elastic plastic. All embodiments comprise a tongue portion 1 of round or flattened rectangular cross section, with a head portion 2 formed to one end thereof in one piece. In the embodiment shown in FIGS. 1 and 2, in which tongue portion 1 is of round cross section, head portion 2, designed as a barrel-like, hammerhead-like enlargement, has a serrated member 3 which engages a longitudinal groove 4 in the tongue portion, whose base has a serration 5. In order to insert tongue portion 1 into head portion 2, head portion 2 has a generally cylindrical slot 6, into which the free, pointed end of the tongue portion is inserted. Serrated member 3 is located on that side of slot 6 in head portion 2 facing away from the connection to tongue portion 1, so that tongue portion 1 must always surround an object to be attached or bundled in such a manner that longitudinal groove 4 is located on the outside and is not in a contacting relationship with the object to be attached.

Serration 5 and the corresponding serration of serrated member 3 are designed in such a manner that the individual teeth have inclined flanks, as viewed in the direction of insertion of the free end of tongue portion 1, with the adjacent flanks being perpendicular or generally perpendicular to the longitudinal axis of slot 6. It is also possible for said adjacent flanks to also be inclined in the direction of the other, inclined longer flanks, thereby creating a back taper. In the representation according to FIG. 1, the serrated member has three teeth for reasons of clarity. In actual practice, it will be practical to provide a significantly greater number of teeth, whereby it will also be practical for serration 5 to be significantly finer.

In order to permit the serrated member to lift away far enough to disengage its teeth from the serration on tongue portion 1 when the binding clip is tightened, recesses 7, which extend parallel to slot 6, weaken the cross section of head portion 2 enough to form two bow-shaped web-like members 8, which connect serrated member 3 with the rest of heat portion 2, in which tongue portion 1 is inserted into slot 6, whose cross section is matched to the configuration of tongue portion 1. In the illustrated embodiment, recesses 7 are of generally circular cross section and are located next to tongue portion 1, displaced 90° relative to longitudinal groove 4. When members 8 are subjected to a pressure exerted laterally relative to tongue portion 1, forces are exerted against the two other areas of head portion 2 at right angles thereto, and cause serrated member 3 to be disengaged from serration 5, thereby permitting the locking effect to be eliminated in this manner. Tongue portion 1 can then be retracted.

Because of the plurality of teeth of serrated member 3, the width of longitudinal groove 4 can be kept relatively narrow. The maximum width therefore corresponds to approximately one third of the diameter of tongue portion 1, however it is preferably even narrower.

A tongue portion 1 of circular cross section with a longitudinal groove 4 provides the advantage that it can be guided over corners or edges especially well, as is necessary for example if an electrical cable is to be attached to a bracket, plate or similar object. If longitudinal groove 4 is very deep in tongue portion 1, in particular deeper than in the embodiment according to FIGS. 1 and 2, the tongue portion can be folded about longitudinal groove 4, so that the two halves thereof, separated by the longitudinal groove, are angled about the edge, adjacent one to the other. It is possible to increase this effect by having longitudinal groove 4 extend not only as far as one half of the diameter of tongue portion 1, as is the case in the illustrated embodiment, but almost as far as the area of the opposite side, in which only a relatively thin web is left, which then forms the base of serration 5. In this connection, it is possible for the teeth of serration 5 not to be connected with the side walls of longitudinal groove 4, but to be located at a distance therefrom, so that they do not hinder the profile from folding upwardly. In an embodiment of this nature, it is then especially recommendable to provide serration 5 on both side walls of longitudinal groove 4 and to provide teeth which are matched to the side flanks or serrated members 3.

Figure 2:
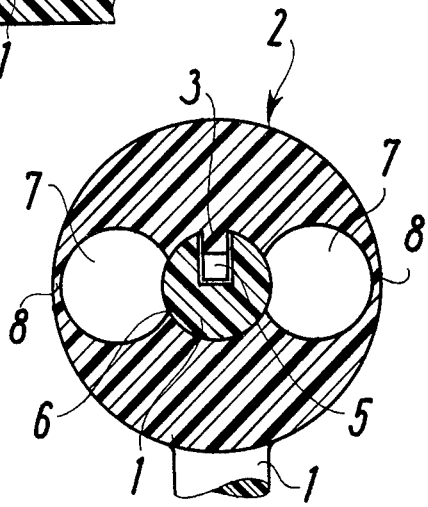
FIG. 2 shows a cross section taken through the head portion along line II—II illustrated in FIG. 1.
Figure 3:
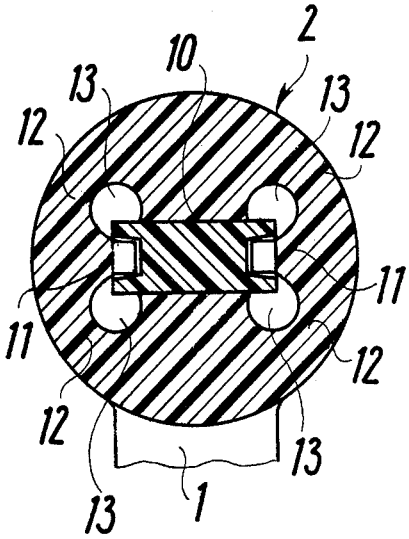
FIG. 3 shows a vertical cross-sectional view taken through the head portion of a further embodiment of the binding clip according to the present invention.
Figure 4:
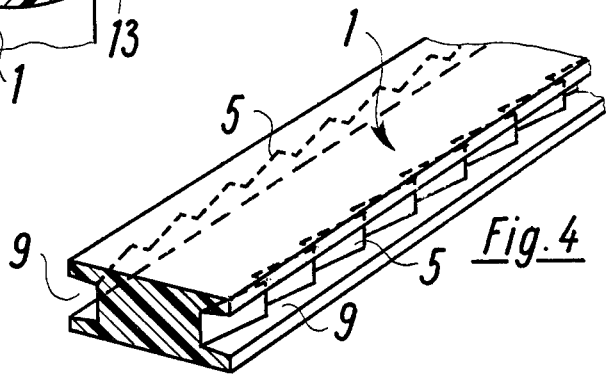
FIG. 4 shows a partially cutaway perspective view of the tongue portion of the binding clip according to FIG. 3.

In the embodiment according to FIGS. 3 and 4, tongue portion 1 is of flat, rectangular cross section, while the cross section of head portion 2 can correspond to that of the embodiment according to FIGS. 1 and 2. It is, of course, readily possible for a different cross section configuration to be selected for the head portion, in particular if an especially low height of the head portion is desired, which is advantageous, for example, if binding clips of this nature are installed in miniature equipment. The side edges of tongue portion 1 have two longitudinal grooves 9, with serration 5 on their bases. The slot 10 in head portion 2 is of matching rectangular configuration, with the two side walls comprising serrated members 11, each having serration which matches serration 5. Serrated members 11 are connected with the remainder of head portion 2 by means of web-like areas 12, which are created by recesses 13 arranged adjacent to slot 10 at the corners thereof. This provides the necessary deformability in order to permit the serrated members to lift away from serration 5. Tongue portion 1 itself has a smooth top and bottom, which can be gripped without discomfort to the user, as there are no rough areas, etc. to come in contact with the user's hand. Longitudinal grooves 9 arranged on the side edges can be narrow, as the necessary closing force is provided by two serrations and two serrated members 11. If longitudinal grooves 9 are relatively deep with respect to the height of serration 5, this provides the advantage that the webs left in the area of the side edges are sufficiently yielding to permit tongue portion 1 of the binding clip to be angled about a cable or similar object, for example, without any risk of damage due to a sharp edge.

Figure 5:
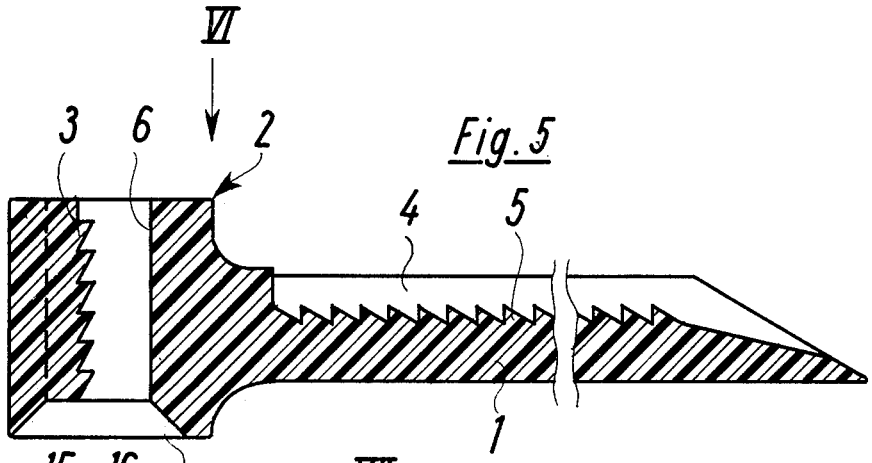
FIg. 5 shows a longitudinal section taken along line V—V of FIG. 6 illustrating a binding clip according to the present invention, having a round cross section.
Figure 6:
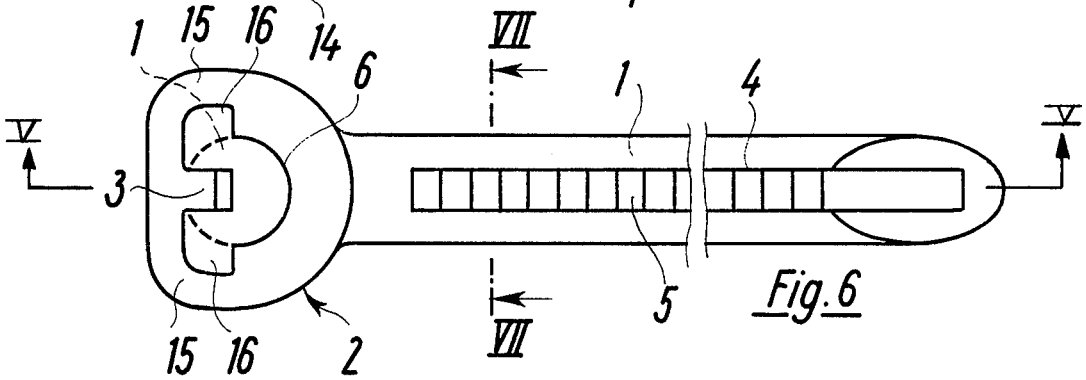
FIG. 6 shows a view of the binding clip taken in the direction of arrow VI in FIG. 5.
Figure 7:
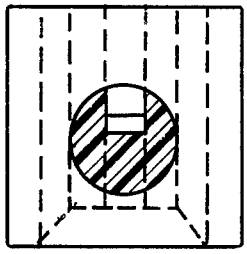
FIG. 7 shows a section taken along line VII—VII in FIG. 6.

The embodiment of the binding clip shown in FIGS. 5 to 7 has a tongue portion 1 of round configuration, to which is formed a head portion 2 having a circumference of a generally D-shaped configuration. Head portion 2 is arranged at one end of tongue portion 1 in the nature of a hammerhead, while the opposite end of tongue portion 1 is cut off at an angle in order to create a point. Tongue portion 1 has a longitudinal groove 4, whose base is designed as serration 5. At least a portion of slot 6 in head portion 2 has a cylindrical cross section which matches that of tongue portion 1, and its axis extends perpendicular to the longitudinal axis of tongue portion 1 and in the direction of the side walls of groove 4; it has a bevel 14 on the side from which the tongue portion is inserted. A serrated member 3, with serration which matches serration 5, projects into this slot 6. Serrated member 3 is retained by two webs 15, formed by recesses 16 formed by widening slot 6 in the area of serrated member 3 and extending in the direction of slot 6. In this embodiment, webs 15 are arranged at a distance from tongue portion 1, which is inserted into head portion 2. If they are subjected to a force in a direction which is radial to tongue portion 1, illustrated as a dashed line in FIG. 6, forces are created within head portion 2 which move serrated member 3 outwardly, causing its serration to disengage serration 5 in tongue portion 1. This design permits the binding clip to be released again and reused after being locked.

In this embodiment, the cross section of head portion 2 is very small, thereby resulting in a favourable height, which makes the binding clips suitable for use in miniature equipment. The flexiblity of tongue portion 1 of the binding clip can be made especially great if groove 4 is designed signficantly deeper, i.e. extends far more than halfway through tongue portion 1 into the lower area. This permits tongue portion 1 to fold away from the base of the groove if it is bent about an edge or similar object. Here, also, it is practical for the side flanks of the teeth of serration 5, whose angles are designed in accordance with FIGS. 1 and 2, not to be connected with the side walls of longitudinal groove 4. In the same manner, it is also possible for the side walls of longitudinal groove 4 and the side flanks of serrated member 3 to have matching serrrations. Since longitudinal groove 4 is also very narrow in this embodiment, i.e. approximately one third of the diameter, the outer surface of tongue portion 1 of the binding clip is completely smooth to the touch of the user, which makes handling very simple and eliminates the danger of injuries. Moreover, this smooth, round cross section can be inserted through attachment holes in a bracket or other object of an item of equipment very simply, without the hole having to have a significantly greater diameter.

Figure 8:
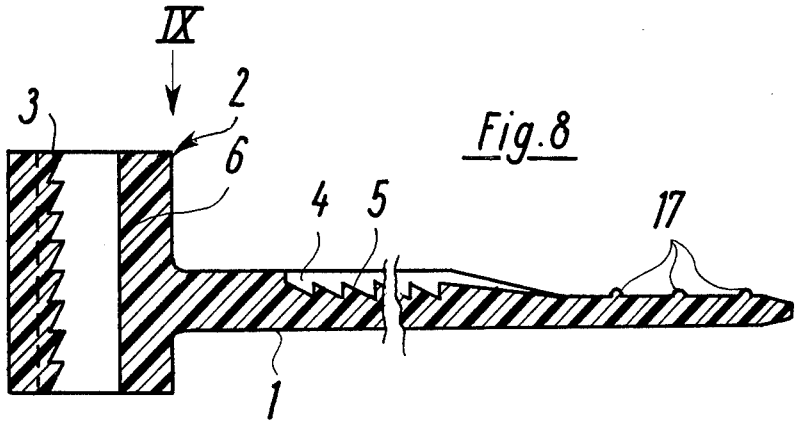
FIG. 8 shows a longitudinal section taken along line VIII—VIII of FIG. 9 illustrating a further embodiment of the binding clip according to the present invention.
Figure 9:
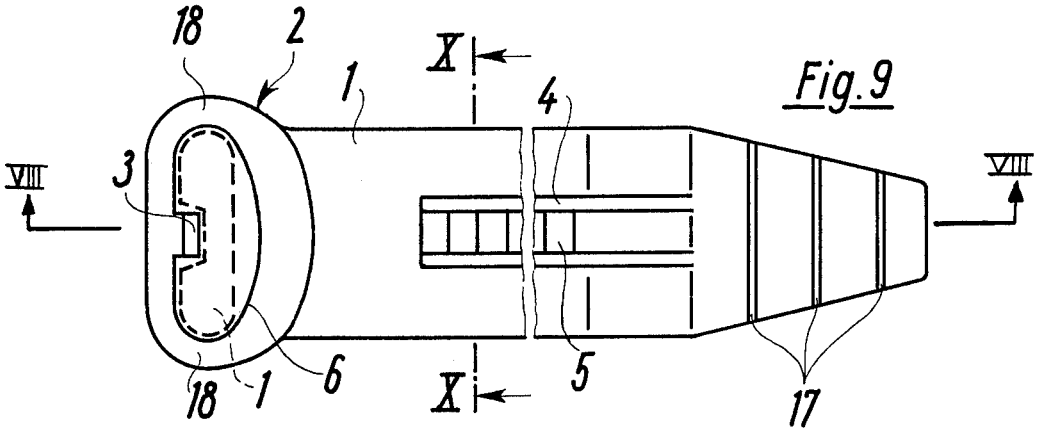
FIG. 9 shows a view of the binding clip according to FIG. 8, taken in the direction of arrow IX.
Figure 10:
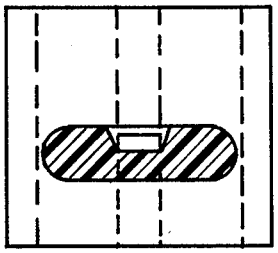
FIG. 10 shows a section taken along line X—X in FIG. 9.

The embodiment according to FIGS. 8 to 10 corresponds basically to the embodiment according to FIGS. 5 to 7, the only differences being that in this embodiment tongue portion 1 is of a generally rectangular cross section, with rounded sides. Slot 6 in head portion 2 is also designed in accordance with this cross section and is formed to tongue portion 1 in one piece, in the nature of a hammer head, having a slightly asymmetrical location relative to tongue portion 1, i.e. that side from which tongue portion 1 is inserted is closer to tongue portion 1 than that side from which it egresses. The free end of tongue portion 1 thins to about one half of the thickness of tongue portion 1 and has laterally extending ribs 17. Moreover, the side edges are bevelled forwardly in this area, thereby simplifying the introduction of tongue portion 1.

Tongue portion 1 has a longitudinal groove 4 on one side, whose base is designed as serration 5. Longitudinal groove 4 and serration 5 are arranged on the side of the tongue portion which faces away from that side which surrounds an object when it is attached or bundled, etc.

A serrated member 3, having serration which matches serration 5, projects into slot 6 in head portion 2, which extends perpendicular to that side of tongue portion 1 on which longitudinal groove 4 is located. This serrated member, which is located on that side of slot 6 which faces away from tongue portion 1, is connected with the remainder of head portion 2 by means of relatively thin-walled webs 18. These webs 18 can be deformed in a highly elastic manner in order to permit serrated member 3 to lift away when tongue portion 1 is inserted into the head portion. The width of slot 6 is generally matched to the width of tongue portion 1. That area of the base of slot 6 which is located opposite serrated member 3 is deepened in a trough-like manner, i.e. expanded in a trough-like manner relative to the cross section of tongue portion 1, indicated in the form of a dashed line in FIG. 9. This permits tongue portion 1 to evade the serrated member elastically when it is inserted. If head portion 2 is subjected to opposite forces from the outside, directed at right angles to tongue portion 1 located in head portion 2, head portion 2 can be deformed together with tongue portion 1. Tongue portion 1 moves into the trough-shaped depression in slot 6, while serrated member 3 remains stationary or moves outwardly, thereby disengaging it from serration 5 in tongue portion 1, so that the binding clip can be released. In order to prevent the side walls of longitudinal groove 4 from clamping around serrated member 3 and retaining it, these walls are inclined in such a manner that the longitudinal groove is of V-shaped configuration. This design can be seen especially clearly in FIG. 10.

A binding clip having a tongue portion 1 corresponding to the embodiment according to FIGS. 8 and 10 is especially well suited for bundling cables in circuits, etc., as the cables are then offered a flat, smooth side. Longitudinal groove 4 is so narrow that the user's fingers cannot reach serration 5 when attaching the binding clip, as the serration is clearly lower than the outside and the longitudinal groove is relatively narrow. In this embodiment, also, the plurality of teeth on serrated member 3 nevertheless provides a high degree of closing force. Moreover, longitudinal groove 4 also provides the advantage that tongue portion 1 can be bent or angled about an axis extending through longitudinal groove 4, thereby permitting it to be matched to an angling of cables, for example. This flexibility of the tongue portion could be increased even further if additional longitudinal grooves, extending parallel to longitudinal groove 4, were provided on that side of the tongue portion containing longitudinal groove 4. Longitudinal groove 4 can be quite deep, with its base extending almost as far as the opposite side. In this connection, it is advantageous for the lateral flanks of the teeth of serration 5 to be arranged at a distance from the walls of longitudinal groove 4. It is also possible to provide the side walls of longitudinal groove 4 and the side surfaces of serrated member 3 with matching serration.

All embodiments of the present invention offer the advantage that the tongue portion of the binding clip offers the user a smooth, physiologically pleasing outer surface, which can also be inserted easily into holes in holders and similar objects. The recessed serrations are located far enough inside the narrow longitudinal grooves so that they cannot be touched. As a result of the longitudinal grooves, the tongue portion of the binding clips offers a smooth surface for the objects to be bundled, connected or attached, on the one hand, as well as a high and novel degree of flexibility on the other. The binding clips nevertheless possess very high closing force, which can readily cope with the overstrains which can almost never be completely avoided in actual practice. The design of the head portion of the binding clips, in particular, is highly compact, thereby enabling them to be installed quite well inside miniature equipment, in particular inside electronic miniature equipment. It is also possible to provide a metallic pawl lacking tongue in head portion 2 in place of serrated member 3; it would then be practical for the metallic pawl to begin on that side of head portion 2 located closer to the end of tongue portion 1, which would then surround the object to be retained with the outer surface containing the longitudinal groove. If no additional metallic members or similar items are employed, the binding clips can be injection moulded of plastic, in one step, economically and simply in appropriate tooling. Moreover, they can be fabricated in any desired size, for example in a size that corresponds to the representation in the drawings or, preferably, in sizes which are only one tenth as large.

Obviously, many modifications and variations of the present invention are possible in the light of the above teachings. It should therefore be understood that within the scope of the appended claims, the invention may be practiced otherwise than as specifically described.

Having thus fully disclosed my invention, what I claim is:

1. A binding clip for bundling cables and similar objects, comprising a head portion having a tongue engagement means, a tongue portion having a pair of opposing major surfaces and a pair of opposing minor surfaces, said tongue portion being connected to said head portion and having a free end insertable into said head portion, and profile means engageable by the engagement means of said head portion when said binding clip is closed, said profile means being fully recessed within both of said minor surfaces.

2. The binding clip according to claim 1, in which said engagement means is at least a serrated member retained in said head portion by means of elastically deformable members.

3. The binding clip according to claim 2, in which a hammerhead-shaped enlargement, containing a slot arranged perpendicular to the longitudinal axis of said tongue portion, into which said engagement means protrude, serves as said head portion.

4. The binding clip according to claim 2, in which two longitudinal grooves are arranged one opposite the other and are provided in said tongue portion, said tongue portion being of flat, generally rectangular cross section, said engagement means protruding laterally into said slot in said head portion when said clip is closed.

5. The binding clip according to claim 3 in which the circumference of said head portion is of generally D-shaped cross section.

6. The binding clip according to claim 3, in which said slot in said heat portion is bevelled on at least that side from which said tongue portion is inserted.

7. The binding clip according to claim 3, in which bow-shaped webs are arranged next to a recess for the tongue portion to be introduced and at a distance therefrom, said webs retaining said serrated member.

8. The binding clip according to claim 3, in which an area of said slot having a trough-shaped depression is arranged opposite said serrated member of said head portion, and in which the flanks of said longitudinal groove of said tongue portion are inclined outwardly.

9. A binding clip for bundling cables and similar objects, comprising a tongue portion and a head portion having a tongue engagement means, said head portion being connected to said tongue portion, a free end of said tongue portion being insertable into said head portion and having at least one longitudinal groove, profile means located within said longitudinal groove and being engageable by the engagement means of said head portion when said binding clip is closed, and wherein said engagement means is connected to the remainder of said head portion by outwardly directed web-like members (8, 12, 15, and 18) for enabling displacement of said engaging means away from said remainder of said head portion to disengage said engagement means from said profile means.

10. The binding clip according to claim 9, in which the longitudinal groove with profile is arranged in that side of said tongue portion facing away from the object or objects to be surrounded, said profile being engaged by said engagement means of said head portion, when said binding clip closes.

11. The binding clip according to claim 10, in which the depth of said longitudinal groove extends at least half as deep as the thickness of the tongue portion.

12. The binding clip according to claim 10, in which the width of said longitudinal groove is generally one third of the width of the tongue portion.

13. The binding clip according to claim 9, wherein the depth of said groove is at least half as deep as the thickness through the center of the tongue portion.

14. The binding clip according to claim 13, wherein said tongue portion is of circular cross-section.

15. The binding clip according to claim 13, wherein said tongue portion is of a generally rectangular cross-section.

16. The binding clip according to claim 13, in which the width of said longitudinal groove is generally one third of the width across the center of said tongue portion.

* * * * *